US007475681B2

(12) United States Patent
Kuji et al.

(10) Patent No.: US 7,475,681 B2
(45) Date of Patent: Jan. 13, 2009

(54) BREATHER APPARATUS IN COMBUSTION ENGINE

(75) Inventors: Yasuhiro Kuji, Kako-gun (JP); Akinobu Wakabayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 12/003,362

(22) Filed: Dec. 21, 2007

(65) Prior Publication Data

US 2008/0210206 A1 Sep. 4, 2008

(30) Foreign Application Priority Data

Dec. 26, 2006 (JP) ..... 2006-349799

(51) Int. Cl.
*F02B 25/06* (2006.01)
*F02B 25/00* (2006.01)

(52) U.S. Cl. ..... 123/573; 123/41.86

(58) Field of Classification Search ..... 123/572–574, 123/41.86, 196 CP, 196 R, 195 AC
See application file for complete search history.

(56) References Cited

U.S. PATENT DOCUMENTS 3,073,293 A * 1/1963 Barker ..... 123/572
4,459,966 A * 7/1984 Sakano et al. ..... 123/573
4,681,068 A * 7/1987 Anno et al. ..... 123/41.86
5,878,731 A * 3/1999 Bedkowski ..... 123/573
6,196,206 B1 * 3/2001 Bedkowski ..... 123/572
6,202,613 B1 * 3/2001 Nagai ..... 123/90.34
7,219,629 B2 5/2007 Miyake et al.
2007/0095335 A1 * 5/2007 Matsuda ..... 123/572

FOREIGN PATENT DOCUMENTS

JP 2004-060531 2/2004

* cited by examiner

*Primary Examiner*—Mahmoud Gimie
(74) *Attorney, Agent, or Firm*—Wenderoth, Lind & Ponack, L.L.P.

(57) ABSTRACT

The present invention provides a breather apparatus in a combustion engine having a sufficient gas-liquid separation function without involving an additional parts such as a breather tank and an arrangement space thereof. A breather chamber is formed in an air cleaner case, and the breather chamber is communicated with a crank case through a breather pipe. Preferably another breather chamber is formed in the crank case in addition to the breather chamber in the air cleaner case, and the breather pipe is connected to a breather outlet of the breather chamber in the crank case. The breather chamber in the air cleaner case is provided in a clean side space on an intake-air downstream side of a filter element.

4 Claims, 5 Drawing Sheets

BREATHER APPARATUS IN COMBUSTION ENGINE

BACKGROUND OF THE INVENTION

1. Field of the Invention

The present invention relates to a breather apparatus in a combustion engine including a crank case, particularly to a breather apparatus suitable for a vehicle combustion engine.

2. Description of the Related Art

Gas leaking from a gap between a cylinder bore and a piston, so-called blow-by gas is mixed with an air in a crank case of a combustion engine while the engine is driving. Because the blow-by gas has a large amount of unburned air-fuel mixture and oil mist, a breather apparatus is provided in the crank case of the combustion engine to suck the blow-by gas into an intake air device such as an air cleaner to re-burn the blow-by gas and to separate the oil mist from the blow-by gas.

In order that the breather apparatus exerts a gas-liquid separation function, it is necessary to ensure the breather chamber having a predetermined volume according to engine output or the like. However, in the structure in which the breather chamber is formed in the crank case, frequently the breather chamber having the desired volume is hardly formed due to a restriction on a space of the crank case. Therefore, when the volume of the breather chamber is increased, it is necessary to enlarge the crank case itself.

On the other hand, there is well known a combustion engine including a breather apparatus in which a breather tank is separately provided outside a crank case as shown in Japanese Unexamined Patent Application Publication No. 2004-60531. In a structure in which the breather tank is provided outside the crank case, the compact crank case can be achieved while a breather chamber having a predetermined volume is ensured. However, because it is necessary to provide a new part of the breather tank, a new arrangement space is required around the crank case, and the number of parts and parts cost are increased. Particularly, in a small-vehicle combustion engine, there is a strong need for the compact crank case and the compact arrangement of equipments around the crank case.

SUMMARY OF THE INVENTION

The present invention addresses the above described condition, and an object of the present invention is to provide a breather apparatus in a combustion engine, which can provide a large volume of a breather chamber with a compact configuration.

In order to accomplish the foregoing object of the present invention, there is in accordance with the present invention provided a breather apparatus in a combustion engine having cylinders arranged in V-shape and a crank case provided with a transmission case, the breather apparatus comprising: an air cleaner case including a filter element for purifying intake air to be supplied to the combustion engine, the air cleaner being disposed above a space formed in V-shape between the cylinders; a first breather chamber provided in the transmission case of the crank case and separating an oil component from a blow-by gas generated in the crank case, the first breather chamber being disposed on an upper portion of the transmission case and having an outlet of the blow-by gas extending rear upward; a second breather chamber provided at a bottom portion of the air cleaner case and separating an oil component from the blow-by gas from the first breathe chamber, the second breather chamber being positioned in a clean side space downstream of the cleaner element and having an inlet of the blow-by gas extending rear downward; a breather pipe for fluidly connecting the outlet of the first breather chamber and the inlet of the second breathe chamber.

With this configuration, since a space in the air cleaner case can be effectively used as the second breather chamber space, it is not necessary to ensure a new breather chamber forming space, so that a large-volume breather chamber can be formed while the compact crank case and the compact arrangement of equipments around the crank case are achieved.

Moreover, since the two-step breather chambers are provided in the transmission case and the air cleaner case, a total volume of the breather chambers can be enlarged to further improve gas-liquid separation performance while the compact crank case and the compact arrangement of the equipments around the crank case—are maintained.

Moreover, since the outlet of the first breather chamber extending rear upward from the upper portion of the transmission case, and the inlet of the second breather chamber extending rear downward from the bottom portion of the air cleaner, a connecting work of the breather pipe become easy.

In addition, since the second breather chamber is disposed in the clean side space of the air cleaner case, invasion of the water and dust through the second breather chamber can be effectively prevented, and the gas component exhausted from the second breather chamber can rapidly be sucked in the intake air after the gas-liquid separation.

Preferably, a part of wall forming the second breather chamber in the air cleaner case may be constituted of a flame arrestor provided in the air cleaner.

With this configuration, an additional member for forming the second breather chamber can be saved.

Preferably, the part of the wall may have small holes.

With this configuration, since the blow-by gas into the second breather chamber collides the part of the wall having small holes, a gas-liquid separation function of the second breather chamber is improved.

Preferably, the flame arrestor is nipped between an element holder for holding the filter element and an element support wall formed on the bottom portion of the air cleaner case from above and beneath.

With this configuration, an installing work of the flame arrestor becomes easy.

BRIEF DESCRIPTION OF THE DRAWINGS

The above and other objects, features, and advantages of the present invention will be become more apparent from the following description taken in connection with the accompanying drawings, in which.

DETAILED DESCRIPTION OF THE PREFERRED EMBODIMENT

FIGS. 1 to 5 show a V-2 cylinder engine for a vehicle according to the present invention, and the V-2 cylinder engine is mainly mounted on a four-wheeled vehicle for all terrain. An embodiment of the present invention will be described below with reference to the drawings.

(Entire Structure of Engine)

Figure 1:
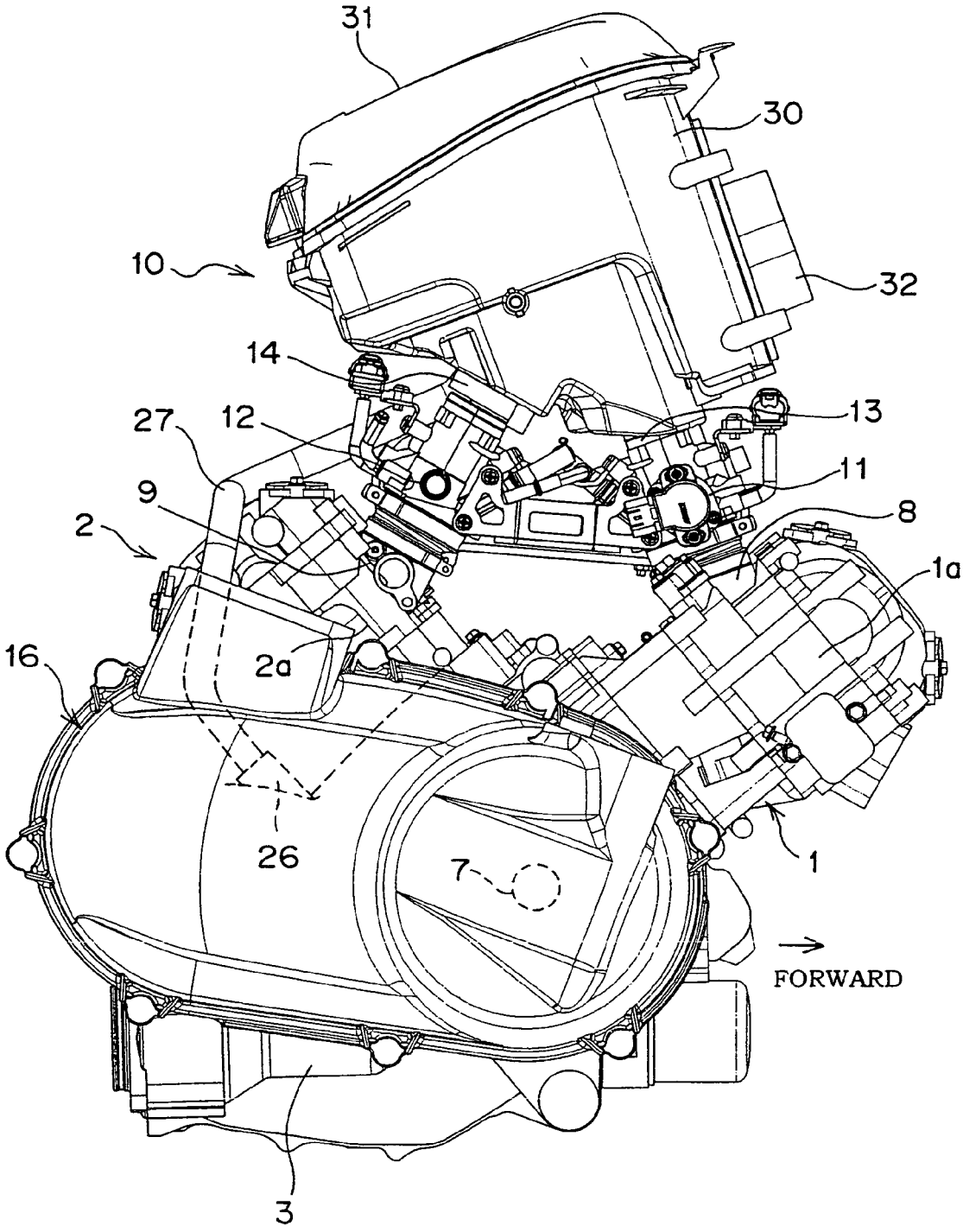
FIG. 1 is a right side view showing a V-2 cylinder engine including a breather apparatus according to an embodiment of the present invention.
Figure 2:
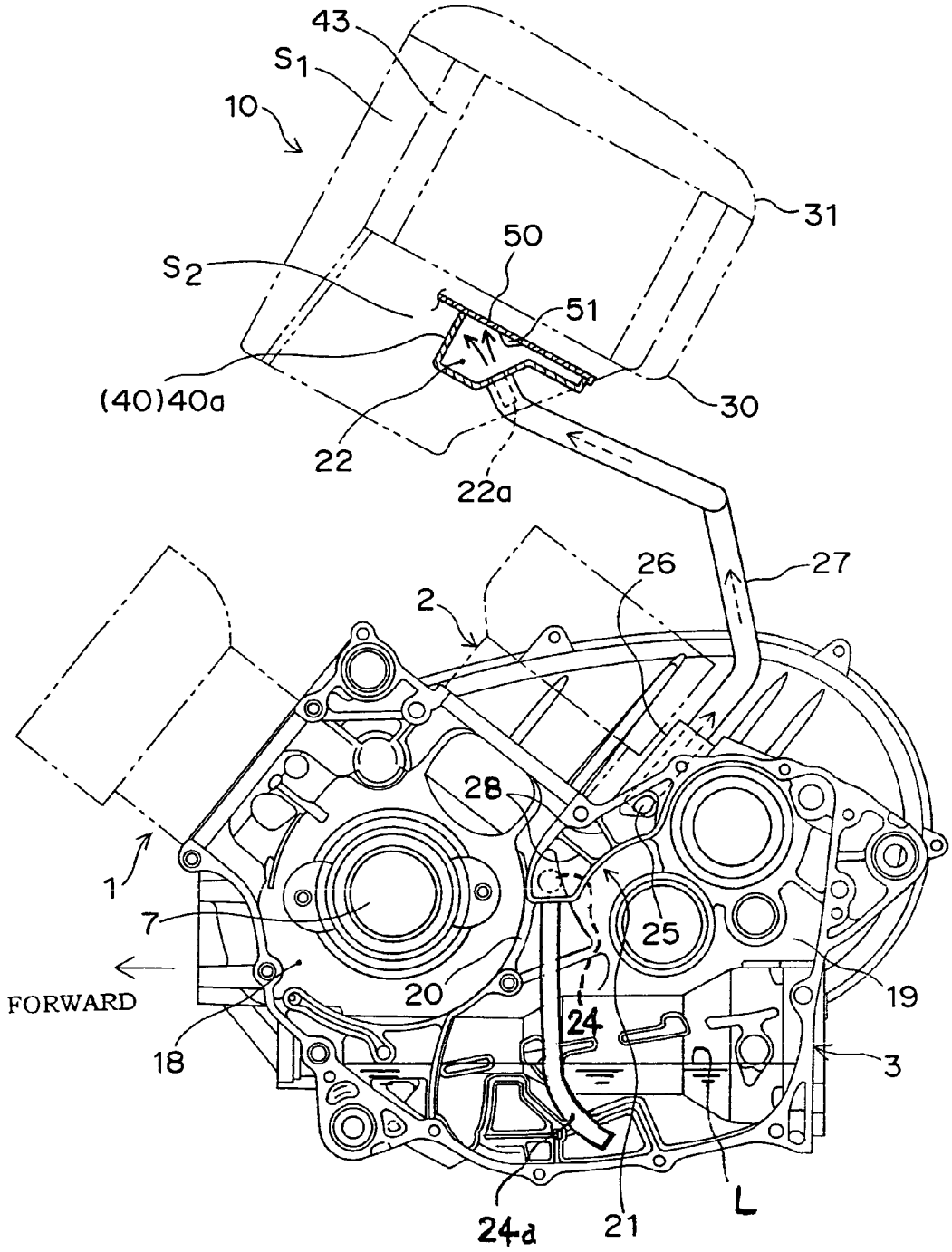
FIG. 2 is a sectional left side view showing a crank case and an air cleaner of the V-2 cylinder engine of FIG. 1.

FIG. 1 is a right side view showing a V-2 cylinder engine, and FIG. 2 is a left side view showing a right-side portion of a crank case 3 which is cut in a substantially central portion of the crank case 3 in a width direction thereof (in a axis direction of a crankshaft 7). Referring to FIG. 1, a first cylinder 1 with a head 1*a* bent forward and a second cylinder 2 with a head 2*a* bent rearward are fastened to an upper end of a forward portion of a crank case 3. Both cylinders 1, 2 are arranged in V-shape when viewed from a lateral direction. Inlet ports 8 and 9 are provided in a rear upper surface of the cylinder head 1*a* of the first cylinder 1 and a front upper surface of the cylinder head 2*a* of the second cylinder 2 respectively, and intake air outlets of throttle devices 11 and 12 are connected to the inlet ports 8 and 9 respectively. The intake air inlets provided in upper end portions of the throttle devices 11 and 12 are connected to first and second cleaner outlets 13 and 14 of an air cleaner 10 disposed above the throttle devices 11 and 12 respectively.

An outer shell of the air cleaner 10 is constituted by a cup-shaped air cleaner case 30 and a case cover 31. The first and second cleaner outlets 13 and 14 are formed in a bottom wall of the air cleaner case 30, and an air intake 32 is formed in a front wall of the air cleaner case 30. A V-belt type transmission 16 is disposed on a right side face of the crank case 3, and the V-belt type transmission 16 couples the crankshaft 7 in the crank case 3 and a gearshift input shaft (not shown) of a gear type sub-transmission disposed in a rear portion of the crank case 3 such that power of the crankshaft can be transmitted.

Referring to FIG. 2, the crank case 3 has a two-block structure with a right crank case member and a left crank case member. The crank case 3 is divided into the right crank case member and the left crank case member at the central portion thereof in the crank shaft axis direction. The crank case 3 is partitioned into a crank chamber 18 and a transmission case 19 by a partition wall 20, the crankshaft 7 is accommodated in the crank chamber 18 located in the front portion of the crank case 3, and the gear type sub-transmission accommodated in the transmission case 19 located in the rear portion of the crank case 3. A first breather chamber 21 is formed in a lower surface of an upper wall of the crank case 3 while being integral with the crank case 3.

(Structure of First Breather Chamber in Crank Case)

As shown in FIG. 2, the first breather chamber 21 is formed near the lowest end portion of the second cylinder 2 when viewed from the side face, and the first breather chamber 21 is located in a range from a neighborhood of the upper end portion of the partition wall 20 to a front end portion of the upper wall of the transmission case 19. The first breather chamber 21 has a two-block structure having right and left chambers corresponding to the two-block structure of the crank case 3, and the first breather chamber 21 is formed on a mating face portion between the crank case members by coupling the right and left crank case members.

The first breather chamber 21 includes a laterally-facing breather inlet 24 and a laterally-facing breather outlet 25. The breather inlet 24 is located in the lower end portion of the first breather chamber 21, and the breather outlet 25 is located in the upper end portion of the first breather chamber 21. Plural baffling walls 28 are formed between the breather inlet 24 and the breather outlet 25 so as to form a winding labyrinth. The breather outlet 25 is communicated with an outlet boss 26 projected in a rear upward direction from the upper wall of the crank case 3, and a lower end portion of a breather pipe 27 is connected to the outlet boss 26.

The breather pipe 27 is extended toward the air cleaner 10 in the forward upward direction, and the breather pipe 27 is connected to an inlet boss 22*a* of a second breather chamber 22 formed in the air cleaner case 30.

(Structure of Air Cleaner and Second Breather Chamber)

Figure 3:
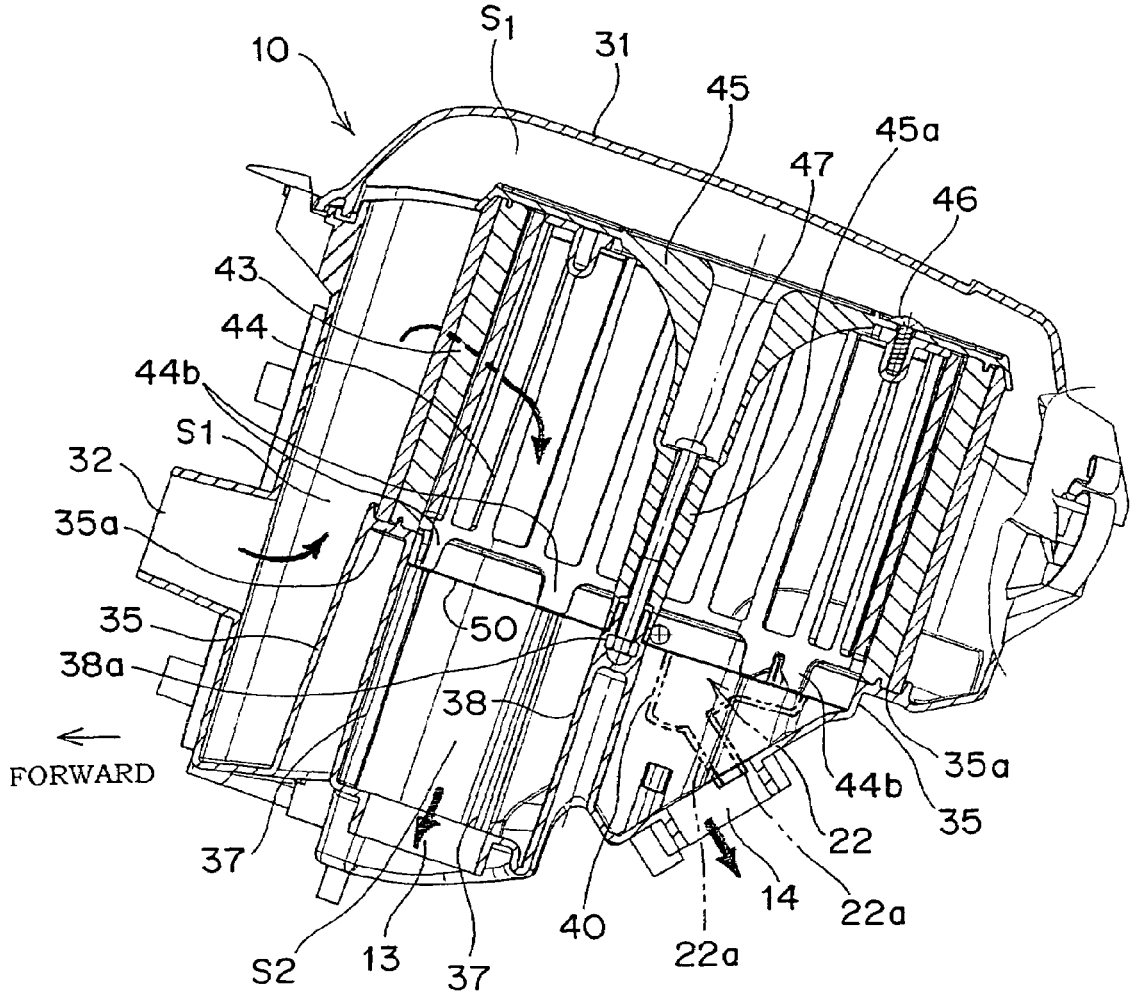
FIG. 3 is a sectional left side view showing the air cleaner of the V-2 cylinder engine of FIG. 1.
Figure 4:
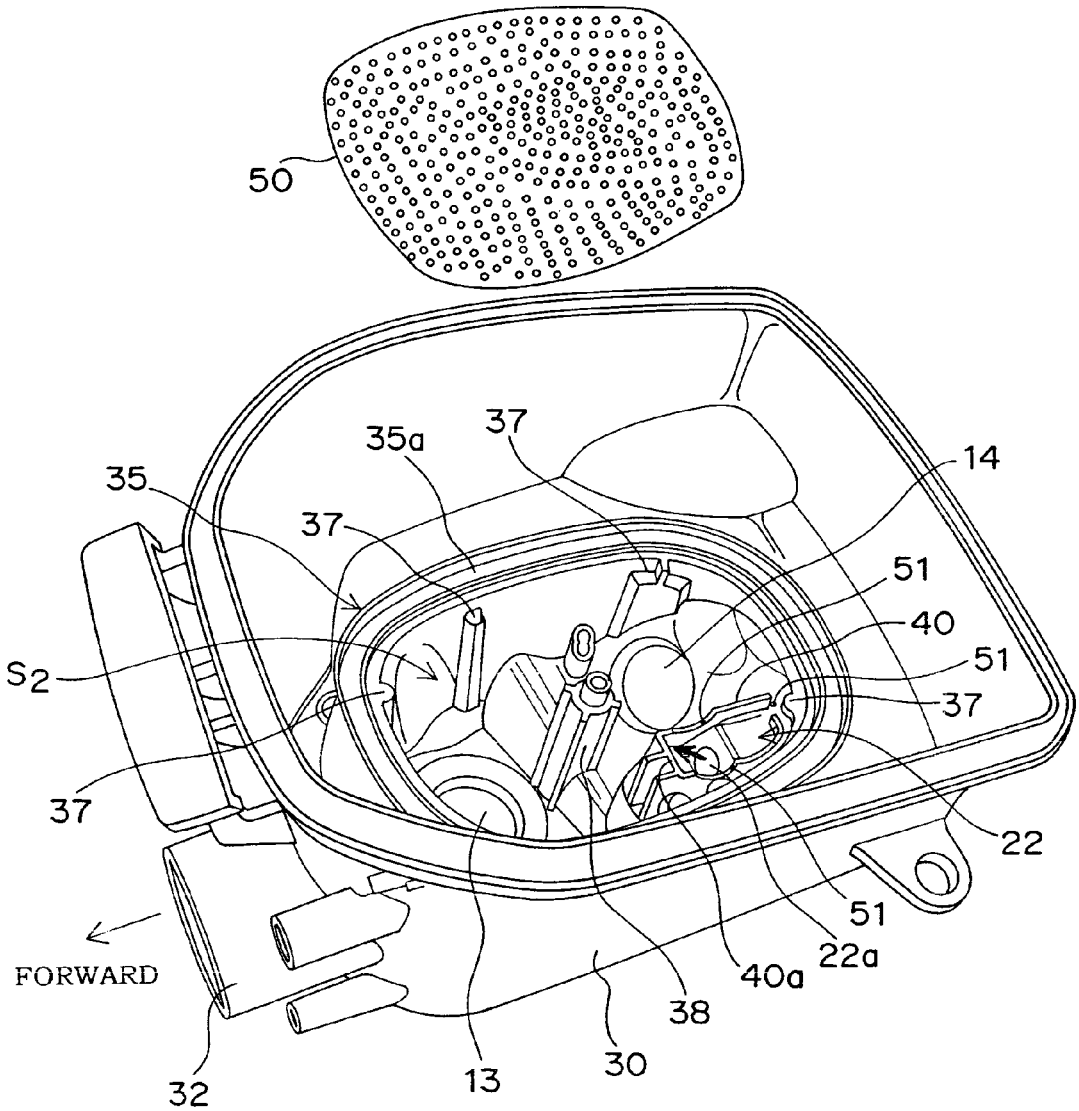
FIG. 4 is a perspective view showing an air cleaner case of the air cleaner of FIG. 3.
Figure 5:
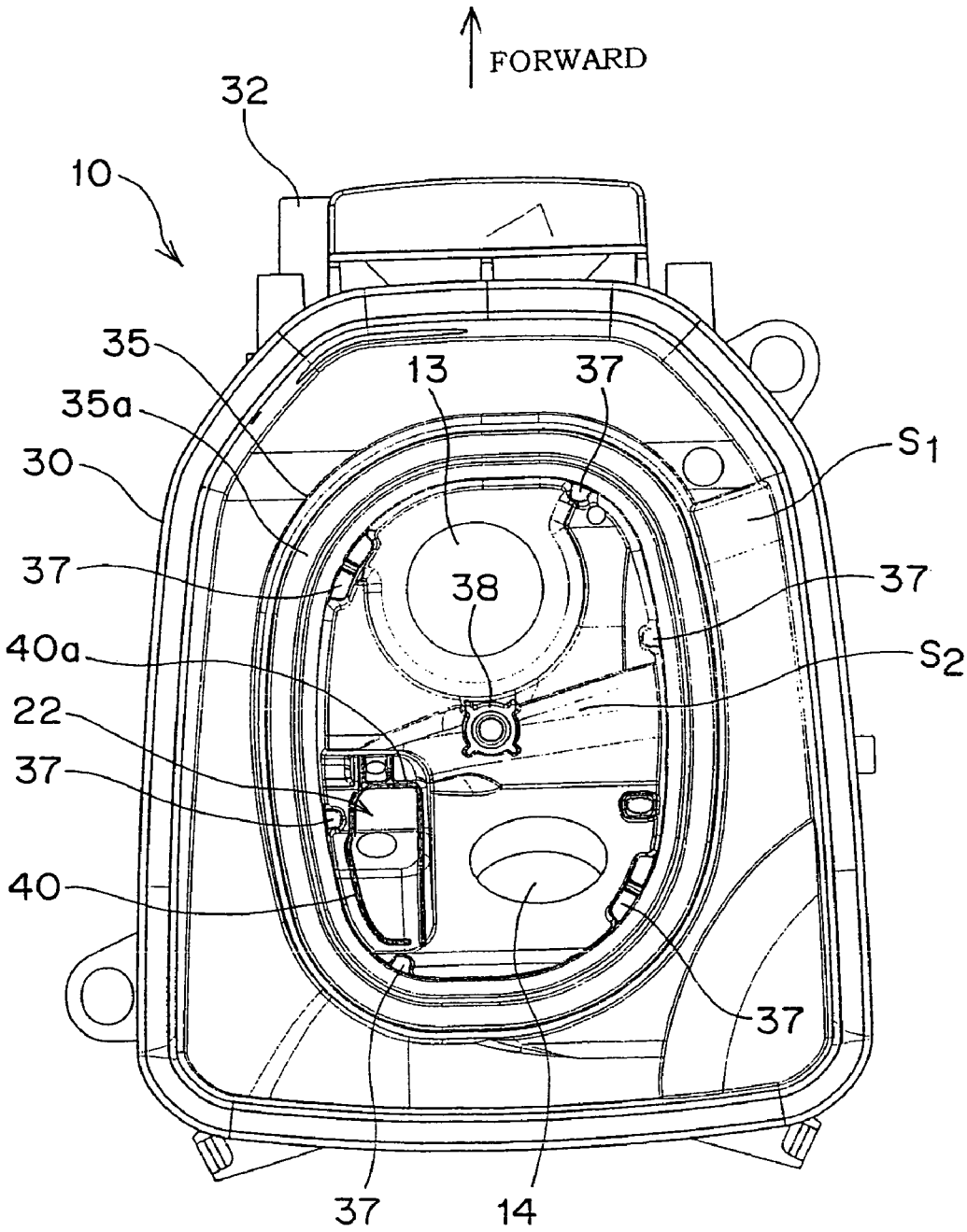
FIG. 5 is a plan view showing the air cleaner case of FIG. 4.

FIG. 3 is a sectional left side view showing the air cleaner 10, FIG. 4 is a perspective view showing the air cleaner case 30, and FIG. 5 is a plan view showing the air cleaner case 30. Referring to FIG. 3 to 5, in the air cleaner case 30, a cylindrical element support wall 35 projected upward from a bottom wall is formed while being integral with the air cleaner case 30. An element support surface 35*a* is formed in an upper end face of the element support wall 35. In an inner circumferential surface of the element support wall 35, plural element holder supporting ribs 37 are formed at predetermined intervals in a circumferential direction. An attaching boss 38 for fixing a top cover 45 of a filter element 43 is formed in a central portion of the element support wall 35. A shape of the element support wall 35 viewed from above is a substantially oval shape extended forward and rearward, and right front end and left rear end portions of the element support wall 35 are formed with a small radius of curvature.

A space on an outer circumferential side of the element support wall 35 constitutes a part of a dirty side space S1 into which unpurified air flows from outside the air cleaner 10, and a space on an inner circumferential side of the element support wall 35 constitutes a part of a clean side space S2 into which purified air purified by the filter element 4 flows. The first and second cleaner outlets 13 and 14 and the second breather chamber 22 are formed in the bottom wall of the clean side space S2. The second breather chamber 22 is located in the left rear end portion of the space in the element support wall 35, and the second breather chamber 22 is surrounded by a breather chamber wall 40 to form a substantially rectangular breather chamber which is extended forward and rearward when viewed from above. A left side wall portion of the breather chamber wall 40 is formed in an arc along the inner circumferential surface of the filter element support wall 35.

Referring to FIG. 3, in a rear-half portion of the element support wall 35, a length in a vertical direction is gradually shortened toward the rear direction. The rear-half portion of the element support wall 35 is formed in the substantially right-angled triangle when viewed from the side face. The filter element 43 formed in cylindrical shape and having a planar shape corresponding to the element support surface 35*a* is placed in the element support surface 35*a* of the element support wall 35. An outer circumferential surface of a cylindrical element holder 44 is fitted in an interior the filter element 43. The element holder 44 is formed in a frame shape having many air vent window holes, and the top cover 45 is fixed to an upper end face of the element holder 44 by a screw 46. An attached boss 45*a* projected downward is formed in a central portion of the top cover 45, and a lower end portion of the attached boss 45*a* is fixed to the upper end portion of the attaching boss 38 of the air cleaner case 30 by a bolt 47. Thus, the top cover 45 is fixed to the attaching boss 38, and the upper end face of the filter element 43 is pressed downward against the lower surface of the outer peripheral end portion of the top cover 45, thereby sealing the upper and lower end faces of the filter element 43.

A flame arrestor 50 is placed on a cover attaching surface 38*a* of the attaching boss 38 and upper end faces of the plural ribs 37 formed in the inner circumferential surface of the element support wall 35. The upper surface of the space in the element support wall 35 is covered with the flame arrestor 50. On the other hand, in the lower end face of the element holder 44, legs 44*b* projected downward are formed at positions corresponding to the ribs 37 while being integral with the element holder 44. The flame arrestors 50 are nipped between each leg 44*b* and each rib 37 and between the cover attaching surface 38*a* of the attaching boss 38 and the lower end face of the attached boss 45*a* of the top cover 45.

The dirty side space S1 of the air cleaner 10 is located in the range from the space on the outer circumferential side of the element support wall 35 to the space on the outer circumferential side of the filter element 43 and in an upper space of the top cover 45. The clean side space S2 is located in the range from the space on the inner circumferential side of the element support wall 35 to the space on the inner circumferential side on the filter element 43.

Referring to FIG. 4, the breather chamber wall 40 of the second breather chamber 22 is integrally and vertically projected from the bottom wall of the air cleaner case 30. Recesses (notch) 51 for exhausting the blow-by gas from the breather chamber 22 are formed in right and left sidewalls and rear wall of the breather chamber wall 40 respectively. The flame arrestor 50 in which many small holes are made in the whole surface thereof is formed by a metal plate, i.e., a so-called punching metal.

The upper surface of the second breather chamber 22 is covered with a part of the flame arrestor 50, and the breather inlet 22*a* is opened in the front upward direction with respect to the breather chamber 22. Therefore, the blow-by gas including the oil mist flowing from the breather inlet 22*a* into the second breather chamber 22 impinges against the flame arrestor 50 and a front wall 40*a* of the breather chamber wall 40.

(Intake Air Flow in Air Cleaner Case)

(1) In FIG. 3, the air taken from the cleaner inlet 32 into the dirty side space S1 of the air cleaner case 30 impinges against the front end portion of the element support wall 35, whereby the water and dirt and the like in the air are separated and fall down.

(2) After the impingement, the air passes through the filter element 43 from the outer circumferential surface of the filter element 43, thereby purifying the air. Then, the air enters the clean side space S2. Then, the air passes through the flame arrestor 50, and the air is supplied from the first and second cleaner outlets 13 and 14 to the first and second throttle devices 11 and 12 of FIG. 1.

(Blow-by Gas Flow in Crank Case)

(1) In FIG. 2, during the operation of the engine, the gas leaks into the crank chamber 18 through the gap between the piston and the cylinder bore of each of the cylinders 1 and 2, the blow-by gas is accumulated from the crank chamber 18 to the transmission case 19 of the crank case 3. A pressure in the crank case 3 always fluctuates by reciprocating motion of the piston in each of the cylinders 1 and 2.

(2) The blow-by gas accumulated in the crank case 3 flows from the breather inlet 24 into the first breather chamber 21 by the increase in pressure of the crank case 3, and the blow-by gas impinges against each baffling wall 28 in the first breather chamber 21 to perform the gas-liquid separation. After the gas-liquid separation, the oil component is returned from a return pipe 24*a* connected to the lower end of the first breather chamber 21 into oil (oil surface L) reserved in the bottom portion of the crank case 3. On the other hand, after the gas-liquid separation, the gas component is exhausted to the breather pipe 27 through the breather outlet 25 and the outlet boss 26. Sometimes the oil component still remains in the gas component and the oil component is discharged to the breather pipe 27 with a gas component.

(3) The gas component (blow-by gas) in the breather pipe 27 in which the oil component remains is discharged from the breather inlet 22*a* toward the front upward direction in the second breather chamber 22, and the blow-by gas impinges against the front wall 40*a* of the breather chamber wall 40 and the flame arrestor 50 to separate the remaining oil component from blow-by gas. The separated oil component is returned to the first breather chamber 21 through the breather pipe 27. On the other hand, after the separation, the gas component is exhausted to the clean side space S2 of the air cleaner case 30 through the recesses 51 of the breather chamber wall 40 and the small holes in the flame arrestor 50, and the gas component is mixed in the intake air.

Effect of Embodiment (1) According to the embodiment, the first breather chamber 21 is formed in the crank case 3, the second breather chamber 22 is formed by utilizing the space in the already-existing air cleaner case 30, and the oil component of the blow-by gas in the crank case 3 is separated by the two-step breather chambers including the breather chambers 21 and 22. Therefore, the compact crank case 3 is achieved, and the large volume of the breather chamber is ensured as a whole without providing the new breather chamber arrangement space around the crank case 3, so that the breather function and the gas-liquid separation function can be improved.

(2) The breather chamber wall 40 is integrated with the already-existing air cleaner case 30, so that the number of parts and the cost can be decreased.

(3) The already-existing flame arrestor 50 is used as a member constituting a part of the outline of the second breather chamber 22 formed in the air cleaner case 30, so that the second breather chamber 22 and the air cleaner 10 can be assembled simultaneously and easily while the number of parts is decreased.

(4) Since the second breather chamber 22 is formed in the clean side space S1 of the air cleaner case 30, risk of the invasion of the water and dust sucked along with the air from the cleaner inlet 32 into the second breather chamber 22 is small. Therefore, the invasion of the water and dust into the crank case 3 through the second breather chamber 22 is effectively prevented.

Other Embodiments (1) In the embodiment, as shown in FIG. 4, the small holes are made in the whole surface of the flame arrestor 50 with which the upper portion of the second breather chamber 22 is covered. Alternatively, in the flame arrestor 50, only a portion corresponding to the second breather chamber 22 may be formed in a shape having no small hole.

(2) Instead of the punching metal shown in FIG. 4, a metal net-shaped member may be used as the flame arrestor 50.

(3) In the embodiment, the breather chambers 21 and 22 are formed at the two points in the crank case 3 and the air cleaner case 10. Alternatively, the breather chamber may be formed only in the air cleaner case 30.

That is, the first breather chamber is omitted in the crank case 3.

(4) The present invention is not limited to the configuration of the embodiment, but various modifications can be made without departing from the scope of the invention.

What is claimed is:

1. A breather apparatus in a combustion engine having cylinders arranged in V-shape and a crank case provided with a transmission case, the breather apparatus comprising:

an air cleaner case including a filter element for purifying intake air to be supplied to the combustion engine, the air cleaner being disposed above a space formed in V-shape between the cylinders;

a first breather chamber provided in the transmission case of the crank case and separating an oil component from blow-by gas generated in the crank case, the first breather chamber being disposed on an upper portion of the transmission case and having an outlet of the blow-by gas extending rear upward;

a second breather chamber provided at a bottom portion of the air cleaner case and separating an oil component from the blow-by gas from the first breathe chamber, the second breather chamber being positioned in a clean side space downstream of the cleaner element and having an inlet of the blow-by gas extending rear downward;

a breather pipe for fluidly connecting the outlet of the first breather chamber and the inlet of the second breathe chamber.

2. The breather apparatus in the combustion engine as claimed in claim 1, wherein a part of wall forming the second breather chamber in the air cleaner case is constituted of a flame arrestor provided in the air cleaner.

3. The breather apparatus in the combustion engine as claimed in claim 2, wherein the part of the wall has small holes.

4. The breather apparatus in the combustion engine as claimed in claim 3, wherein the flame arrestor is nipped between an element holder for holding the filter element and an element support wall formed on the bottom portion of the air cleaner case from above and beneath.

* * * * *